US005900682A

United States Patent [19]

Hung

[11] Patent Number: 5,900,682

[45] Date of Patent: May 4, 1999

[54] PULL CHAIN SWITCH CIRCUIT DEVICE CAPABLE OF STEPLESS CONTROL OF BRIGHTNESS OF LIGHTING FIXTURES OF CEILING FAN

[75] Inventor: Wen-Hui Hung, 2F, No. 98, Lane 1, Sec. 2, Chung San Road, Pan Chiao City, Taipei Hsien, Taiwan

[73] Assignee: Wen-Hui Hung, Taipei Hsien, Taiwan

[21] Appl. No.: 08/926,443

[22] Filed: Sep. 10, 1997

[51] Int. Cl.[6] ..... H01H 3/22

[52] U.S. Cl. ..... 307/125; 307/130; 338/198; 315/209 R; 315/362; 200/51.15

[58] Field of Search ..... 307/125, 130; 340/825.22; 338/172, 198; 315/209 R, 216, 362; 200/51.15, 329

[56] References Cited

U.S. PATENT DOCUMENTS 3,643,052 2/1972 Marshall ..... 200/51.15
4,937,513 6/1990 Hoemann et al. ..... 318/772
5,488,273 1/1996 Chang ..... 340/825.22
5,546,067 8/1996 Schmidt et al. ..... 338/198

*Primary Examiner*—Albert W. Paladini
*Attorney, Agent, or Firm*—Browdy and Neimark

[57] ABSTRACT

A pull chain switch circuit device for a stepless control of brightness of lighting fixtures of a ceiling fan is composed of a central control unit, a voltage stabilizing and rectifying unit, a pull chain switch, a protective unit, a zero crossing loop, and a gate unit. The input end of the voltage stabilizing and rectifying unit is connected with an alternating current source, whereas the output end of the voltage stabilizing and rectifying unit is connected with the central control unit. The pull chain switch has one end connected with the output end of the voltage stabilizing and rectifying unit. The protective unit is connected with the alternating current source and the central control unit. The zero crossing loop is connected with the alternating current source and the central control unit for detecting a time point at which the alternating current source becomes 0V. The gate unit is capable of being activated by a trigger signal transmitted by the central control unit at such time when the pull chain switch is pulled. The stepless control of brightness of lighting fixtures of the ceiling fan is brought about by a persistent pulling of the pull chain switch.

8 Claims, 2 Drawing Sheets alternating current source trigger signal driving current

PULL CHAIN SWITCH CIRCUIT DEVICE CAPABLE OF STEPLESS CONTROL OF BRIGHTNESS OF LIGHTING FIXTURES OF CEILING FAN

FIELD OF THE INVENTION

The present invention relates generally to the lighting fixtures of a ceiling fan, and more particularly to a pull chain switch circuit device capable of controlling brightness of the lighting fixtures of a ceiling fan in a stepless manner.

BACKGROUND OF THE INVENTION

The conventional lighting fixtures of a ceiling fan are generally provided with a simple ON-OFF switch incapable of adjusting brightness of the ceiling fan lighting fixtures. The conventional ON-OFF switch can therefore result in inconvenience under the circumstances calling for various degrees of brightness of the lighting fixtures of the ceiling fan. A remote control device may be used to overcome such a problem as described above; nevertheless it is not economically feasible. An alternative way to control brightness of the lighting fixtures of a ceiling fan is to use a touch control device, which consists of a sensing piece capable of controlling brightness of the lighting fixtures of a ceiling fan upon being touched. This alternative way is in fact rather inconvenient. A cheaper way to control brightness of the lighting fixtures of a ceiling fan is to use a wall control device bearing a relatively low price tag and capable of an effective control of brightness of the lighting fixtures of a ceiling fan. However, the installation of the wall control device is time-consuming.

SUMMARY OF THE INVENTION

The primary objective of the present invention is to provide a ceiling fan with a pull chain switch circuit device capable of stepless control of brightness of the lighting fixtures of the ceiling fan.

The another objective of the present invention is to provide a ceiling fan with a pull chain switch circuit device capable of easy and simple stepless control of brightness of the lighting fixtures of the ceiling fan.

In keeping with the principle of the present invention, the foregoing objectives of the present invention are attained by a pull chain switch circuit device, which is composed of a central control unit, a voltage stabilizing and rectifying unit, a pull chain switch, a protective unit, a zero crossing loop, and a gate unit. The voltage stabilizing and rectifying unit has an input end connected with an alternating current source, and an output end connected with a power supply input end of the central control unit. The pull chain switch has one end connected with the output end of the voltage stabilizing and rectifying unit. The protective unit has two input ends connected with two input ends of the alternating current source, and an output end connected with a power source input end of the central control unit. The zero crossing loop has an input end connected with the alternating current source, and a detection output end connected with a zero crossing end of the central control unit. The gate unit has a gate end connected with a signal output end of the central control unit, an input end connected with the lighting fixtures of a ceiling fan, and an output end connected with ground. The brightness control of lighting fixtures of the ceiling fan is brought about by a persistent pulling of the pull chain switch.

The foregoing objectives, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
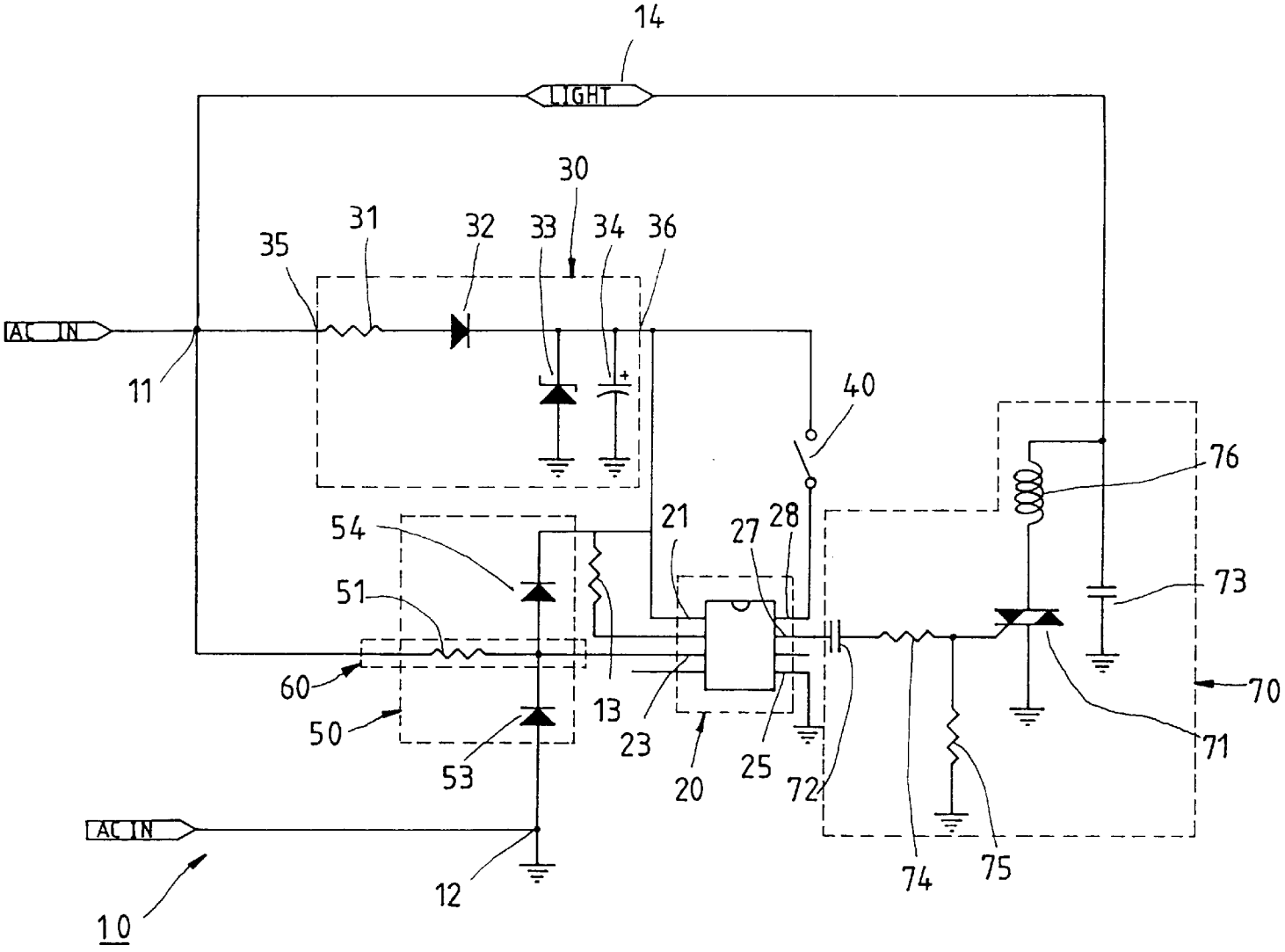
FIG. 1 shows a circuitry of the embodiment of the present invention.

As shown in FIG. 1, a circuit device 10 of the embodiment of the present invention and a lamp 14 of a ceiling fan are arranged in parallel connection on the circuit of the alternating current source. The lamp 14 has an input end, which is connected with a first input end 11 of the alternating current source. The circuit device 10 is composed of a central control unit 20, a voltage stabilizing and rectifying unit 30, a pull chain switch 40, a protective unit 50, a zero crossing loop 60, and a gate unit 70.

The central control unit 20 is an integrated circuit, e.g. ASIC with 8 pins, with pin 1 being a power source input end 21, pin 3 being a zero crossing end 23, pin 5 being a ground end 25, pin 7 being a signal output end 27, and pin 8 being a signal input end 28. The remainders of the pins are not the subject matter of the present invention. Any suitable unit, such as another integrated circuit, may be substituted for the particular control unit illustrated and described above.

The voltage stabilizing and rectifying unit 30 is made up of a first resistance 31, a first diode 32, a schottky-barrier double rectifier diode 33, and a first capacitor 34. The voltage stabilizing and rectifying unit 30 has an input end 35 which is connected with the first input end 11 of the alternating current source, and an output end 36 which is connected with the input end 21 of the central control unit 20. The alternating current is allowed to enter the first input end 11 and then to pass the first resistance 31. The negative voltage is confined by the first diode 32, whereas only the positive voltage is allowed to pass. The voltage is further confined to be 5V by the schottky-barrier double rectifier diode 33. Through the charging and the discharging of the first capacitor 34, the stable 5V direct current is made available via the output end 36 to the central control unit 20.

It must be noted here that the output end 36 is connected with one end of a second resistance 13. The second resistance 13 has another end, which is connected with a pin 2 of the central control unit 20.

The pull chain switch 40 is connected at one end thereof with the output end 36 of the voltage stabilizing and rectifying unit 30, and at another end thereof with the signal input end 28 of the central control unit 20. When the pull chain switch 40 is pulled, a signal is transmitted to the central control unit 20.

The protective unit 50 is composed of a third resistance 51, a third diode 53, and a fourth diode 54. The third resistance 51 has one end which is connected with the first input end 11 of the alternating current source, and another end which is connected with the zero crossing end 23. The anode of the third diode 53 is connected with the second input end 12 of the alternating current source, whereas the cathode of the third diode 53 is connected with the zero crossing end 23. The anode of the fourth diode 54 is connected with the zero crossing end 23, whereas the cathode of the fourth diode 54 is connected with the input end 21 of the central control unit 20. The third diode 53 and the fourth diode 54 are clamping diodes for protecting the central control unit 20.

The zero crossing loop 60 is formed of the third resistance 51 of the protective unit 50. The third resistance 51 is connected at one end thereof with the first input end 11 of the alternating current source, and at another end thereof with the zero crossing end 23 of the central control unit 20. The zero crossing loop 60 provides an AC signal, reduced in magnitude by resistor 51, to the central control unit 20 for detecting a time point at which the zero crossing is brought about.

The gate unit 70 is composed of a triode alternating current switch (TRIAC) 71, a second capacitor 72, a third capacitor 73, a fourth, resistor 74, a fifth capacitor 75, and an electrosensor 76. The second capacitor 72 has an input end which is connected with the signal output end 27, and an output end which is connected with the input end of the fourth resistance 74. The fourth resistance 74 has an output end, which is connected with the gate of the TRIAC 71. The input end of the fifth resistance 75 is connected with the gate of the TRIAC 71, whereas the output end of the fifth resistance 75 is connected with the ground. The output end of the TRIAC 71 is connected with the ground, whereas the input end of the TRIAC 71 is connected with the output end of the electrosensor 76. The electrosensor 76 has an input end, which is connected with an output end of the lighting fixture (lamp) 14. The input end of the third capacitor 73 is connected with the output end of the lamp 14, whereas the output end of the third capacitor 73 is connected with the ground.

Figure 2A:
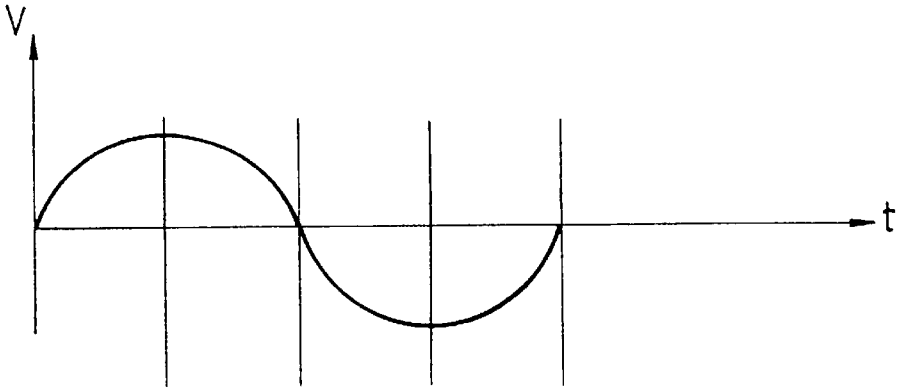
FIGS. 2A–2C show diagrams illustrating the driving angles of the alternating current source of the embodiment of the present invention.
Figure 2B:
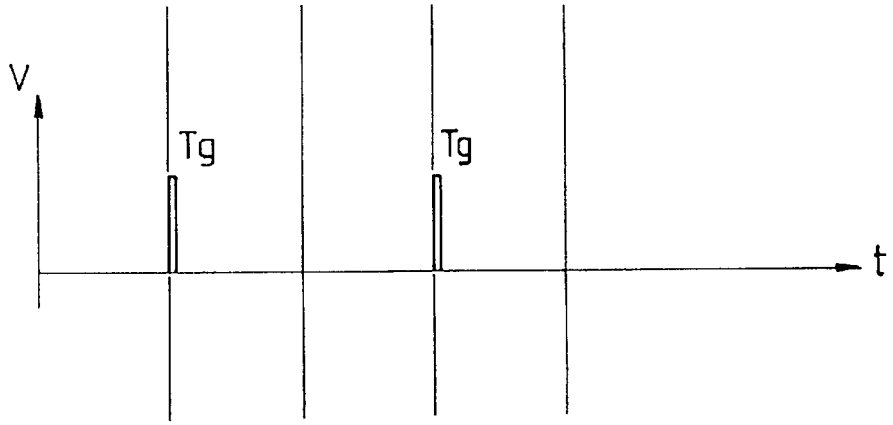
Figure 2C:
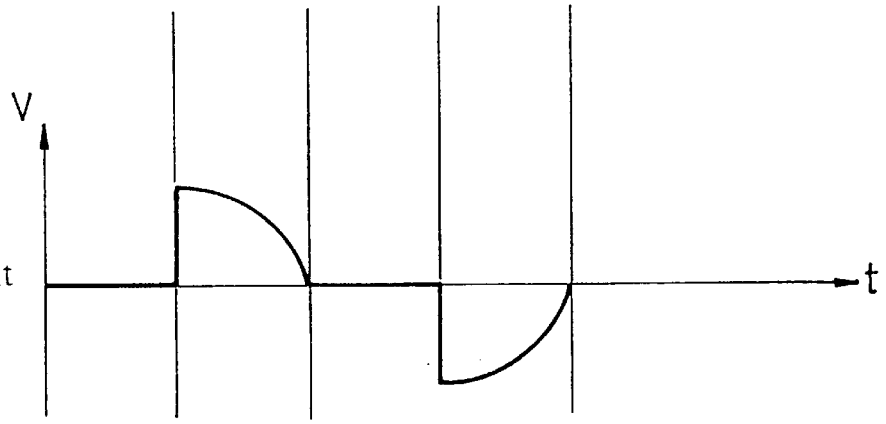

As illustrated in FIGS. 2A–2B, when the device 10 of the present invention is connected to AC, the central control unit 20 is powered by the stable 5V power source which is provided by the voltage stabilizing and rectifying unit 30. In the meantime, no output signal is available at the signal output end 27 of the central control unit 20. As soon as the pull chain switch 40 is pulled, a signal is entered via the signal input end 28. That is, switch 40 is normally closed. The signal is then processed by the central control unit 20. As a result, a trigger signal Tg is transmitted from the signal output end 27 to the TRIAC 71, which is then activated by the trigger signal Tg. The current is thus made available to the lamp 14, thereby causing the lamp 14 to emit light. The current reaches the ground via the lamp 14, the electrosensor 76 and the TRIAC 71. In view of the fact that the initial voltage of the semi-wave form of the positive voltage or the negative voltage is OV, the TRIAC 71 is switched to the open (non-conducting) state from the conducting state, and remains in the open state, at such time when the alternating current source wave form returns to OV from the positive voltage or the negative voltage. As a result, another trigger signal Tg is called for to enable the TRIAC 71 to remain in the conducting state. In other words, the trigger signal Tg having a period corresponding to one half of the alternating current period must be transmitted continuously from the signal output end 27 of the central control unit 20, so as to enable the TRIAC 71 to remain uninterruptedly in the driving state in the positive half period and the negative half period of the wave form of the alternating current source, thereby making it possible for the lamp 14 to emit continuously the light of a specific brightness. In addition, the zero crossing loop 60 serves to detect the time point, at which the voltage happens to be OV, as the basis of an original point for transmitting the trigger signal Tg. In accordance with the time point of the original point, the entry point of the trigger signal Tg entering the wave form of the alternating current source is modulated for controlling the driving angle of the TRIAC 71 as well as the driving power of the current. As a result, the brightness of the lamp 14 can be controlled in a stepless manner.

Accordingly, when the pull chain switch 40 is pulled and released immediately, a pull-release signal is received by the central control unit 20, which transmits continuously the trigger signal Tg having a period corresponding to one half of the alternating current period. In the meantime, a maximum driving angle is attained to enable the lamp 14 to emit light of a maximum brightness.

The brightness of the lamp 14 at work can be adjusted by pulling and then holding the pull chain switch 40 for a specific period of time, such as 0.4 second. As a result, the central control unit 20 is capable of an adjustment of the trigger time within the period, so as to modulate the emitting power or brightness of the lamp 14, with the adjustment range being in a cycle of dim→bright→dim.

The lamp 14 at work can be turned off by pulling the pull chain switch 40, which is then released quickly.

What is claimed is:

1. A pull chain circuit device capable of a stepless control of brightness of a lighting fixture of a ceiling fan, said circuit device comprising:

a central control unit including at least a power source input end, a zero crossing end, a ground end, a signal output end, and a signal input end;

a voltage stabilizing and rectifying unit including an input end connected with an alternating current source, and an output end connected with the power source input end of said central control unit;

a pull chain switch connected at one end thereof with said output end of said voltage stabilizing and rectifying unit, and at another end thereof with said signal input end of said central control unit;

a protective unit including two input ends connected with the input end of said alternating current source and ground, said protective unit further including an output end connected with said power source input end of said central control unit:

a zero crossing loop including an input end which is connected with said alternating current source, said zero crossing loop further including a crossing output end which is connected with said zero crossing end of said central control unit for detecting a time point of said alternating current source becoming 0 V; and a gate unit including a gate end connected with said signal output end, said gate unit further including an input end which is connected with the lighting fixture and an output end connected with ground;

wherein the central processor unit controls the brightness via the gate unit according to a zero crossing time and the signal input from the pull chain switch.

2. The circuit device as defined in claim 1, wherein said central control unit is an integrated circuit of ASIC and including 8 pins.

3. The circuit device as defined in claim 1, wherein said voltage stabilizing and rectifying unit consists of:

a resistance including an input end connected with said alternating current source, said resistance further including an output end;

a diode including an anode connected with said output end of said resistance, said diode further including a cathode, said diode intended to prevent entry of negative voltage;

a schottky-barrier double rectifier diode connected with said cathode of said diode and intended to keep voltage at 5V; and a capacitor including an anode arranged in parallel connection with said schottky-barrier double rectified diode, said capacitor further including a cathode arranged in parallel connection with said schottky-barrier double rectifier diode, said capacitor intended to keep voltage at 5V.

4. The circuit device as defined in claim 1, wherein said protective unit comprises a resistance and two clamping diodes for protecting said central control unit.

5. The circuit device as defined in claim 1, wherein said zero crossing loop comprises a resistance, said resistance including one resistance end connected with said alternating current source, said resistance further including another resistance end connected with said zero crossing end of said central control unit, said zero crossing loop enabling said central control unit to detect a time point at which said alternating current source becomes 0 V.

6. The circuit device as defined in claim 1, wherein said gate unit comprises a triode alternating current switch; and wherein said signal output end of said central control unit transmits a trigger signal to said gate unit, so as to activate said gate unit to remain in a driving state.

7. A ceiling fan lamp unit (10) powerable by an AC line (11), the lamp unit having a pull-chain brightness control comprising:

a DC power supply (30) converting the AC to DC;

a central control unit (20) having a power input (21) coupled to the power supply;

a normally-open, momentary-contact switch (40) coupled to the pull-chain and connected between the power supply and a signal input (28) of the central control unit;

a gate device (71) in series with the lamp, the gate device having a conducting state and an open state;

wherein the central control unit includes a zero-crossing input (23) coupled to the AC for detecting a zero-voltage instant of the AC;

wherein a momentary closing of the switch (40) causes the central control unit to change between outputting trigger signals ($T_g$) to the gate device and not outputting the trigger signals to the gate device; and wherein a trigger time of the trigger signals, relative to the zero-voltage instant of the AC detected at the zero-crossing input, is variable by continuously closing the switch.

8. The ceiling fan lamp unit according to claim 7, wherein said gate unit comprises a triode alternating current switch.

* * * * *